United States Patent [19]

Kadooda

[11] Patent Number: 4,465,562

[45] Date of Patent: Aug. 14, 1984

[54] PROCESS FOR SURFACE TREATMENT OF ALUMINUM ARTICLE

[75] Inventor: Tsuneo Kadooda, Kakogawa, Japan

[73] Assignee: Honny Chemicals Company, Limited, Kobe, Japan

[21] Appl. No.: 347,147

[22] Filed: Feb. 9, 1982

Related U.S. Application Data

[63] Continuation of Ser. No. 148,929, May 12, 1980, abandoned, which is a continuation-in-part of Ser. No. 111,299, Jan. 11, 1980, abandoned.

[51] Int. Cl.[3] ..... C25D 11/24

[52] U.S. Cl. ..... 204/38 A; 204/37.6; 204/38 E

[58] Field of Search ..... 204/38 A, 38 E, 181 R, 204/35 N; 427/409; 148/6.27

[56] References Cited

U.S. PATENT DOCUMENTS

| | | | |
|---|---|---|---|
| 3,428,618 | 2/1969 | Cook et al. | 526/204 |
| 3,547,859 | 12/1970 | Kometani et al. | 526/255 |
| 3,585,084 | 6/1971 | Steinbrecher et al. | 148/6.2 |
| 3,622,473 | 11/1971 | Ohta et al. | 204/38 A |
| 3,711,313 | 1/1973 | Nagano et al. | 204/38 A X |
| 3,799,848 | 3/1974 | Kolic et al. | 204/38 E |
| 4,084,014 | 4/1978 | Fabregas | 427/409 |

*Primary Examiner*—G. L. Kaplan
*Assistant Examiner*—W. T. Leader
*Attorney, Agent, or Firm*—Stevens, Davis, Miller & Mosher

[57] ABSTRACT

A process for the surface treatment of an aluminum article characterized by dipping an aluminum article which has been anodically oxidized and which has a surface structure in an active state into a polymer latex thereby forming a water-insoluble polymer coating layer on the surface of said aluminum article, said polymer latex being prepared by polymerizing one or more of ethylenically unsaturated monomers in such a manner that polymer particles of said polymer latex are negatively charged and said polymer latex being adjusted to a pH value below 3.0.

4 Claims, No Drawings

PROCESS FOR SURFACE TREATMENT OF ALUMINUM ARTICLE

CROSS-REFERENCE TO RELATED APPLICATIONS

This is a continuation of application Ser. No. 148,929 filed May 12, 1980, now abandoned, which in turn is a continuation-in-part of application Ser. No. 111,299, filed Jan. 11, 1980, now abandoned.

BACKGROUND OF THE INVENTION

This invention relates to a process for the surface treatment of an aluminum article. More specifically, this invention relates to a process for the surface treatment of an aluminum article which has been anodically oxidized and which has a surface structure in an active state.

Conventionally, aluminum articles are generally subjected to an anodic oxidation in an electrolyte such as sulfuric acid, oxalic acid, chromic acid and the like in order to provide the aluminum articles with an anticorrosive property. The oxidized film formed on the aluminum articles by anodic oxidation comprises a porous $\gamma$-$Al_2O_3$ layer having a number of micro-pores having a diameter on the order of 100 to 500 Å, but such a layer is not sufficiently anticorrosive and, therefore, is generally subjected to hydrate sealing treatment in boiling water or pressurized steam or is coated with a resin over the anodically oxidized surface. The conventional methods for resin coating include spray coating of a solution or dispersion of a resin dissolved or suspended in water or an organic solvent; electrostatic coating by providing resin particles with electrostatic charge at the same time of spray coating; formation of a resin coating film by taking advantage of the viscosity of a resin solution and the volatility of a solvent, comprising dipping the article to be coated in a solution of resin dissolved or suspended in an organic solvent or water; formation of a resin film electrically comprising dipping an article to be coated in a solution of a water-soluble or water-dispersible resin and passing a D.C. or A. C. electric current between the electrodes provided in the solution; formation of a molten film of a resin by jet-spraying a resin powder toward the heated article to be coated or contacting the heated article with a fluidized resin powder, and the like.

SUMMARY OF THE INVENTION

The present invention provides a novel process for the surface treatment of aluminum articles which is radically different from the conventional process in the coating mechanism.

In summary, the present invention is directed to a process for forming a water-insoluble resin layer on an aluminum article which has been anodically oxidized and which has a surface structure in an active state, by dipping the aluminum article in a polymer latex prepared by polymerizing one or more of ethylenically unsaturated monomers in such a manner that polymer particles of the polymer latex are negatively charged and adjusted to a pH value below 3.0.

DETAILED DESCRIPTION OF THE INVENTION

The term "surface structure in an active state" used herein means an anodized surface which has not been completely sealed so that it is dyeable in a green color when tested according to a modification of JIS (Japanese Industrial Standard) H 8683 as follows:

(1) the aluminum article with anodized surface is dipped in a test solution at 20° C. for 15 minutes prepared by dissolving 1 w/v% Aluminum Green GLW (C.I. Mordant Green 50) in deionized water. (Specific resistance should be larger than $50\times10^4\Omega$cm).

(2) the film is then rubbed 3–4 times in one direction, using a soft sponge, followed by washing with water, and is then dried (3) the surface is observed before and after the above two steps, and if it retains a green shade after the test, the surface structure is considered to be in an active state, i.e., not completely sealed.

An equivalent method which can be used to determine whether the surface structure is in an active state, i.e., not completely sealed, is set forth in ASTM B136-72 entitled Standard Method for Measurement of Stain Resistance of Anodic Coatings on Aluminum. In that method, the test area of the anodized specimen is contacted with nitric acid solution and, after rinsing and drying, a dye solution of Aluminum Blue 2LW (Sandoz Colors and Chemicals) (C.I. Acid Blue 69 C. I. 63610) followed by rinsing and rubbing the test area with pumice powder, drying and visually examining the test area for retention of dye stain. Any visible retention of dye color in the test area or any visible change of the color of the coating from the action of the test indicates that the anodized surface has not been completely sealed and is thus in an active state.

The procedural steps of the process according to the present invention are similar to those of the conventional dipping coating method, but the present invention clearly distinguishes from the conventional method in the mechanism forming a resin layer on the surface of the article to be treated. That is, a typical conventional dipping coating method comprises dipping an aluminum article which has been subjected to an anodic oxidation in a water-soluble paint and then pulling up thereby forming a resin coating layer physically adhered to the surface of the article. Accordingly, if the resin layer is washed with water immediately after it is formed, most of the layer is again dispersed in water. On the other hand, according to the process of this invention, a strongly adhered water-insoluble resin layer which does not disperse again in water upon washing with water can be formed on the surface of an aluminum article when an anodically oxidized aluminum article having an active surface structure is dipped in a polymer latex which is obtained by polymerizing one or more of ethylenically unsaturated monomers in such a manner that the polymer particles are negatively charged and which is adjusted to a pH value less than 3.0.

In dipping coating methods, it is necessary to control viscosity, solid content and specific gravity of the paints, and the pulling up rate of the coated article and setting after coating in order to obtain a thick and uniform coating layer. Accordingly, in dipping coating, a paint suitable for the dipping coating must be prepared and, in particular, for the dipping coating of anodically oxidized aluminum articles, water-soluble resin paints having a viscosity of $27\pm5$ cps, a solid content of 20 to 35%, pH 8.0–8.7 and a specific gravity of 0.955 to 0.975 have been mainly used.

Further, polymer latexes have been considered unsuitable as paints for the dipping coating method in which the coating film is formed by taking advantage of the viscosity of the paint, since polymer latexes generally have very low viscosity. In the process of this invention, such polymer latexes can be used and yet a high density, water-insoluble resin layer can be advantageously formed even from a latex having a low solid content, e.g., 1%.

As described above, the present invention differs from the conventional dipping coating methods in the resin film forming mechanism, though the procedure for dipping in a resin solution appears to be the same as that of the conventional dipping coating methods. Actually, the present invention is closely related to the electrodeposition coating technique.

However, the process according to the present invention also differs from the electrodeposition coating methods which utilize electric power, and the characteristic feature of the present invention resides in the fact that a high density resin layer which is strongly adhered to the surface of an article can be formed by a mere dipping technique.

The process according to the present invention is described hereinafter in more detail. The aluminum article used in the present invention is first subjected to an anodic oxidation. The electrolyte which can be used in the anodic oxidation can be sulfuric acid, chromic acid, boric acid, phosphoric acid, pyrophosphoric acid, molybdenic acid, oxalic acid, sulfamic acid, sulfosalicylic acid, sulfosuccinic acid, malonic acid, tartaric acid, citric acid, etc. alone or as a mixture. The thickness of anodically oxidized film is not critical, but a thickness less than about 1$\mu$ is not practically useful as an oxidized film and a thickness more than about 35$\mu$ is unnecessary. Generally, the thickness is about 1 to about 35$\mu$, preferably 3 to 20$\mu$.

The anodically oxidized aluminum article is generally washed with water upon completion of oxidation in order to remove any remaining electrolyte. The surface of the aluminum article which has been subjected to the usual anodic oxidation is, of course, dyed in the sealing test based on the dyeability described above, but the present invention is not necessarily limited to the use of such aluminum articles. It is also contemplated to include the use of anodically oxidized aluminum articles which are further treated with warm water, sometimes with boiling water, pressurized steam, etc. The process of the present invention does not exclude such treatments after anodic oxidation, but the aluminum articles must have a surface structure in an active state and an anodically oxidized film having a surface structure which is dyeable in the sealing test based on the dyeability.

This is due to the fact that the anodically oxidized film has been found to lose its activity when the film is subjected to sealing treatments such as boiling water, pressurized steam or a metal salt treatment for a long period of time after the anodic oxidation and whereby the film becomes ineffective in the present invention.

The present invention also contemplates the use of anodically oxidized aluminum articles which have been colored with a coloring material such as dyes, pigments, polymeric colorants, or colored by dipping or electrolysis in a metal salt aqueous solution bath, or which have been subjected to a treatment for forming a wood-like pattern on the surface thereof, so long as they are dyeable in the sealing test by dyeability as described above.

The polymer latex used in the present invention can be obtained by emulsion polymerization of one or more of monomers containing ethylenically unsaturated double bonds.

Examples of monomers containing ethylenically unsaturated bouble bonds are acids such as acrylic acid, methacrylic acid, itaconic acid, maleic acid and the like; acrylic or methacrylic type monomers such as alkyl acrylates, alkyl methacrylates, hydroxyalkyl acrylates, hydroxyalkyl methacrylates, acrylamides, methacrylamides or N-methylol compounds or N-alkoxymethylol compounds thereof, acrylnitrile, methacrylonitrile and the like; styrene type monomers such as styrene, p-chlorostyrene, $\alpha$-methylstyrene and the like; vinyl type monomers such as vinyl acetate, vinyl propionate and the like; diene type monomers such as butadiene, isoprene, chloroprene and the like. Also, monomers having phosphoric acid groups and ethylenically unsaturated double bonds, for example primary phosphoric acid esters of hydroxy-containing acrylates or methacrylates such as mono(2-hydroxyethyl acrylate) acid phosphate, mono(2-hydroxyethyl methacrylate) acid phosphate, mono(2-hydroxypropyl acrylate) acid phosphate, mono(2-hydroxypropyl methacrylate) acid phosphate, mono(3-hydroxylpropyl acrylate) acid phosphate, mono(3-hydroxylpropyl methacrylate) acid phosphate and the like; allylalcohol acid phosphates; vinyl phosphoric acid; para-vinylbenzenesulfonic acid; monomers having sulfonic acid groups and ethylenically unsaturated double bonds, for example, sulfomethyl acrylate, 2-sulfoethyl acrylate, 2-sulfopropyl acrylate, 3-sulfopropyl acrylate, sulfomethyl acrylate, 2-sulfoethyl methacrylate, 2-sulfopropyl methacrylate, 3-sulfopropyl methacrylate and the like; styrenesulfonic acid, vinylsulfonic acid, allylsulfonic acid and the like can be used.

The polymer latex can be obtained by the well known procedure for polymerization of one or more of the above-described monomers.

The process of the present invention is directed to surface treatment comprising dipping in a polymer latex an aluminum article which has been anodically oxidized and which has a surface structure dyeable in the sealing test based on dyeability, thereby forming a water-insoluble resin film on the surface of the aluminum article. In the process of this invention, the polymer latex should have a pH below 3.0 and the surface of polymer particles in the polymer latex should be negatively charged, since it has been found that any polymer latex having a pH higher than 3.0 does not form a water-insoluble resin film on the aluminum article which has been anodically oxidized and which has a surface structure in an active state, upon dipping in the polymer latex. Furthermore, a polymer latex which does not contain negatively charged polymer particles cannot form a water-insoluble resin film on the aluminum article even if the polymer latex has a pH below 3.0.

An anionic polymerization initiator and/or an emulsifying agent can be used for obtaining an anionic polymer latex wherein the polymer particles are negatively charged. Alternatively, monomers containing functional groups which render the polymer latex electrically negative can be used.

In the present invention, the type and the amount of components for the polymer latex are not critical, so long as the resulting polymer particles in the polymer latex are negatively charged as a whole. For example, either a polymerization initiator such as 4,4'- azobisisobutyloamidinium hydrochloride or an anionic type emulsifying agent such as sodium laurylsulfonate can be used in the present invention to render the polymer particles electrically negative as a whole.

Accordingly, the polymerization for producing the polymer latex used in the present invention can be achieved, for example, by emulsion polymerization using an emulsifying agent such as nonionic surface active agents, anionic surface active agents or cationic surface active agents and an initiator such as potassium persulfate, ammonium persulfate and the like (radical emulsion polymerization) or a redox initiator such as a combination of hydrogen peroxide and $Fe^{2+}$. Alternatively, the polymerization can be effected by emulsion polymerization without using emulsifying agents or by emulsion-suspension polymerization using azobisisobutylonitrile, benzoyl peroxide and the like.

Examples of nonionic surface active agents are polyoxyethylene lauryl ether, polyoxyethylene cetyl ether, polyoxyethylene nonyl phenyl ether, sorbitan monolauryl ester, sorbitan dioleyl ester, polyoxyethylene sorbitan monostearyl ester and the like. Examples of anionic surface active agents are sodium oleate, sodium lauryl alcohol sulfate, stearyl alcohol sulfuric acid ester triethanolamine salt, sodium dodecylbenzenesulfonate, potassium octylnaphthalenesulfonate, sodium dioctylsulfosuccinate, sodium polyoxylaurylsulfate, potassium polyoxyethylene nonyl phenolsulfate and the like. Examples of cationic surface active agents are laurylamine acetate, lauryltrimethylammonium chloride, oleylbenzyldimethylammonium chloride, polyoxyethylene laulylamine and the like.

The pH adjustment of the polymer latex can be achieved by adding a mineral acid such as sulfuric acid, hydrochloric acid, nitric acid and the like, or an organic acid such as acetic acid, oxalic acid and the like.

The resin concentration of the polymer latex used in the present invention is suitably 0.5 to 60% by weight (solid resin content), and at a concentration less than 0.5% by weight, the water-insoluble resin layer formed is thin and the adhesion of the layer to the aluminum article is poor. At a concentration higher than 60% by weight, the viscosity of the latex increases undesirably thereby making it difficult to prepare a stable polymer latex. From the economical standpoint in considering the thickness of resin film and precipitation rate, a concentration of 1 to 40% by weight is preferred. The time required for dipping the anodically oxidized aluminum article having a surface structure in an active state in a polymer latex to form a water-insoluble resin layer on the aluminum article varies depending upon the desired thickness of resin film, but the formation of resin layer is observed even in 10 seconds after dipping and a resin film of 5 to 30μ thickness can be generally obtained within a period of 30 seconds to 10 minutes.

After completion of the dipping, the aluminum article pulled up from the polymer latex is placed in water, if necessary, to remove any excess of the polymer latex adhered to the article and thereafter dried. The drying can be generally carried out at a temperature from room temperature to 200° C. for a period of 5 to 30 minutes, but if an unsaturated monomer containing a functional group, for example, an ethylenically unsaturated monomer having a glycidyl group, a hydroxy group, an amido group, a methylol group, an alkoxymethylol group and the like is copolymerized in the polymer latex, or the polymer latex contains thermosetting epoxy compounds, amino compounds, blocked polyisocyanate compounds, phenol compounds, etc., it is necessary to conduct the drying at an elevated temperature and for a drying time required for the hardening reaction of the resin.

The aluminum article which is contemplated in the process of this invention is not limited to those having a specific shape or size and can be plates, sticks, rods, wires, or other articles having a complicated shape. Further, when a large molded article such as an aluminum window sash is treated by the process of this invention, the article can be hung in either a horizontal direction or vertical direction.

The present invention is further illustrated in greater detail by the following Examples but they are not to be construed as limiting the present invention. Unless otherwise indicated, all parts in these Examples are by weight.

PREPARATION OF LATEX A 150 parts of deionized water, 0.1 part of sodium laurylsulfate and 0.5 part of potassium persulfate were charged into a four-necked flask equipped with a stirrer, a thermometer, a refluxing condensor, a dropping funnel and a nitrogen gas introducing conduit, and the mixture was warmed to 80° C. while stirring. Then, a mixture of 50 parts of ethyl acrylate, and 50 parts of methyl methacrylate was added dropwise to the flask through the dropping funnel over a period of 2 hours. After completion of the addition, the mixture was allowed to react for an additional 4 hours to prepare a latex having a conversion rate more than 95%. The resulting latex was diluted to a solid content of 20% by weight and the pH value of the diluted latex was found to be 2.5.

PREPARATION OF LATEX B

A 0.02N aqueous ammonium hydroxide solution was added to Latex A obtained above to adjust the pH to 3.5.

PREPARATION OF LATEX C

A latex having a conversion rate more than 90% was prepared using azobisisobutyloamidinium hydrochloride in place of potassium persulfate used in the preparation of Latex A. The resulting latex was diluted to a solid content of 20% by weight and the pH value of the diluted latex was found to be 6.5.

PREPARATION OF LATEX D

A 0.05N aqueous sulfuric acid solutio was added to Latex C obtained above to adjust the pH to 2.5.

PREPARATION OF LATEX E

Latex A was further diluted to a solid content of 5% by weight and the pH value of the diluted latex was found to be 3.1.

PREPARATION OF LATEX F

A 0.01N aqueous hydrochloric acid solution was added to Latex E obtained above to adjust the pH value to 2.6.

PREPARATION OF LATEX G

In the same manner as described for the preparation of Latex A, a mixture of 54 parts of ethyl acrylate and 36 parts of methyl methacrylate was added dropwise to 210 parts of deionized water, 4 parts of oxyethylene oxypropylene block polymer (Pronon 208, a product of Nihon Oils & Fats Co., Ltd., Japan), 4 parts of polyoxyethylene nonylphenol ether (Emulgen 920, a product of Kao Atlas Co., Ltd., Japan) and 0.25 part of azobisisobutylonitrile to prepare a latex. The resulting latex was diluted to a solid content of 20% by weight and the pH value of the diluted latex was found to be 6.6.

PREPARATION OF LATEX H

A 0.05N aqueous sulfuric acid solution was added to Latex G obtained above to adjust the pH value to 2.0.

PREPARATION OF LATEX I

A latex was prepared in the same manner as described for the preparation of Latex A but using each of 2 parts of oxyethylene oxypropylene block polymer (Pronon 208) and 2 parts of polyoxyethylene nonylphenol ether (Emulgen 920) in place of sodium laurylsulfate used in the preparation of Latex A. The resulting latex was further diluted to a solid content of 20% and the pH value of the diluted latex was found to be 2.5.

PREPARATION OF LATEX J

A latex was prepared in the same manner as described for the preparation of Latex A, but using 2 parts of sodium laurylsulfate and 0.05 part of potassium persulfate. The resulting latex was diluted to a solid content of 20% by weight and the pH value of the diluted latex was found to be 3.5.

PREPARATION OF LATEX K

A 0.05N aqueous sulfuric acid solution was added to Latex J obtained above to adjust the pH value to 2.8.

PREPARATION OF LATEX L

A latex was prepared in the same manner as described for the preparation of Latex A but using 45 parts of ethyl acrylate, 45 parts of methyl methacrylate and 10 parts of acrylic acid. The resulting latex was diluted to a solid content of 20% by weight and the pH value of the diluted latex was found to be 2.5.

PREPARATION OF LATEX M

A latex was prepared in the same manner as described for the preparation of Latex L but using5 parts of acrylic acid and 5 parts of 2-hydroxyethyl methacrylate. The resulting latex was diluted to a solid content of 20% by weight and the pH value of the diluted latex was found to be 2.5.

EXAMPLES 1 TO 4 AND COMPARATIVE EXAMPLES 1 TO 2

Each of aluminum plates which had been anodically oxidized and subjected to various sealing treatments was dipped in Latex A for 5 minutes at room temperature and then pulled up, washed with water and air-dried. The resulting conditions of each of the aluminum plates are shown in Table 1 below.

TABLE 1

| Sample No. | Example 1 1 | Example 2 2 | Example 3 3 | Example 4 4 | Comparative Example 1 5 | Comparative Example 2 6 |
|---|---|---|---|---|---|---|
| Condition of Coating film | Water-insoluble film was formed | Water-insoluble film was formed | Water-insoluble film was formed | Water-insoluble film was formed | Coating film was washed out by washing with water | Coating film was washed out by washing with water |
| Thickness of Coating Film (μ) | 16 | 16 | 13 | 12 | 0 | 0 |
| Dyeability Test | +++ | +++ | + | + | − | − |

+++: deeply dyed
++: dyed
+: faintly dyed
−: not dyed

The aluminum plates of Table 1 which were anodically oxidized had been subjected to the following post-treatments.

Sample

#1: Washing with water.

#2: Washing with water and then washing with warm water (dipping in deionized water at 85° C. for 5 minutes).

#3: Water washing and then semi-sealing treatment (dipping in deionized hot water at 95° C. for 10 minutes).

#4: Water washing and then semi-sealing treatment (dipping in an aqueous solution of nickel sulfate at 95° C. for 5 minutes).

#5: Washing with water and then sealing treatment (dipping in boiling deionized water at 60 minutes).

#6: Washing with water and then sealing treatment (allowing to stand in a steam atmosphere for 30 minutes under a pressure of 4 kg/cm$^2$).

The dyeablity test was conducted by dipping each of the samples in a 1% W/V aqueous solution of Aluminum Green GLW used in the dye solution dipping test and described previously for 15 minutes and, after washing with water, evaluating the degree of dyeing according to the following rating:

+++: deeply dyed
++: dyed
+: faintly dyed
−: not dyed

As indicated above, the substantially equivalent method of ASTM B136-72 can alternatively be used to evaluate the degree of dyeing or staining.

EXAMPLE 5

Extruded aluminum articles were subjected to degreasing, etching, neutralizing and water washing pretreatments and then subjected to an anodic oxidation in a 15% W/W aqueous sulfuric acid solution at a 15 D.C. voltage for 30 minutes, followed by washing in a water stream for 20 minutes. The resulting extruded aluminum articles were then dipped in Latex A, B, C, D, J or K for 1 minute and thereafter taken out from the latex bath and water rinsed and air-dried. The results obtained are shown in Table 2 below.

TABLE 2

| Latex | A | B | C | D | J | K |
|---|---|---|---|---|---|---|
| Condition of Coating Film | Water-insoluble film was formed | No coating film was formed | No coating film was formed | Water-insoluble film was formed | No coating film was formed | Water-insoluble film was formed |
| Thickness of Coating Film (μ) | 5 | 0 | 0 | 5 | 0 | 5 |

EXAMPLE 6

An aluminum plate which had been subjected to anodic oxidation was dipped in Latex E or F for 3 minutes and pulled up for draining, followed by air-drying. In this procedure, no coating film was observed on the aluminum plate dipped in Latex E, whereas a coating film in a thickness of about 8μ was formed on the aluminum plate dipped in Latex F.

EXAMPLE 7

An extruded aluminum article which had been subjected to anodic oxidation was dipped in an aqueous solution containing 1 g/l of silver nitrate, 2 g/l of selenious acid and 15 g/l of sulfuric acid and subjected to electrolysis at A.C. 15 V for 2 minutes by providing a pair of electrodes in the solution to color the aluminum article in gold color. The colored extruded aluminum article was then dipped in Latex I for 5 minutes and pulled up for draining, followed by air-drying. In this procedure, a coating film having a thickness of 15μ was formed on the colored oxidized film. Upon subjecting the uncoated colored aluminum article to the dyeability test, the aluminum article was colored in green on the golden color background.

In the above procedure, the extruded aluminum article was treated while hanging vertically.

COMPARATIVE EXAMPLE 3

Anodically oxidized aluminum plates were dipped in either of Latexes G and H for 5 minutes and then pulled up for draining, followed by washing with water. In this procedure, formation of water-insoluble coating film was not observed in either case.

PREPARATION OF LATEX N AND EXAMPLE 8

A latex was prepared by emulsion polymerization in the same manner as described for the preparation of Latex A but using no sodium lauryl sulfate and using 0.5 part of 4,4'-azobisisobutyloamidinium hydrochloride in place of potassium persulfate.

The resulting latex was diluted to a solid content of 20% by weight and 0.5 g/l of sodium lauryl sulfate was added to the diluted latex whereby the pH of the resulting minute was found to be 6.7. An anodically oxidized aluminum plate was dipped in the above mixture but no precipitation of resin was observed. However, precipitation of resin was observed when the pH value was adjusted to 2.5 with 0.1N sulfuric acid. Further, no precipitation of resin was observed in the diluted latex adjusted to pH 2.5 with 0.1N sulfuric acid without addition of sodium lauryl sulfate.

What is claimed is:

1. A process of forming a water-insoluble polymer coating layer on a surface of an aluminum article consisting essentially of dipping an aluminum article which has been anodically oxidized and which has a surface structure in an active state into a composition consisting essentially of a polymer latex, said polymer latex having a pH value below 3.0, and being prepared by emulsion polymerization of one or more ethylenically unsaturated monomers whereby the polymer particles of said latex are negatively charged, said composition being substantially free of any oxidizing agent, and drying the polymer coated article.

2. The process according to claim 1, wherein said anodically oxidized aluminum article has an oxidized film thickness of about 1 to about 35μ.

3. The process according to claim 1, wherein said ethylenically unsaturated monomers are selected from the group consisting of hydroxyalkyl acrylates, hydroxyalkyl methacrylates, acrylamides, methacrylamides, and N-methylol compounds or N-alkoxymethylol compounds thereof, and wherein the drying is conducted at an elevated temperature to harden the polymer coating.

4. The process according to claim 1, wherein the resin concentration of the polymer latex used is about 0.5 to 60% by weight.

* * * * *